US012291382B2

(12) United States Patent
Allen

(10) Patent No.: US 12,291,382 B2
(45) Date of Patent: May 6, 2025

(54) WRAPPING MATERIAL FOR TOBACCO INDUSTRY PRODUCTS

(71) Applicant: BRITISH AMERICAN TOBACCO (INVESTMENTS) LIMITED, London (GB)

(72) Inventor: Thomas Robert Allen, London (GB)

(73) Assignee: NICOVENTURES TRADING LIMITED, London (GB)

( * ) Notice: Subject to any disclaimer, the term of this patent is extended or adjusted under 35 U.S.C. 154(b) by 407 days.

(21) Appl. No.: 17/594,472

(22) PCT Filed: Apr. 15, 2020

(86) PCT No.: PCT/GB2020/050956

§ 371 (c)(1),
(2) Date: Oct. 18, 2021

(87) PCT Pub. No.: WO2020/212696

PCT Pub. Date: Oct. 22, 2020

(65) Prior Publication Data

US 2022/0194674 A1 Jun. 23, 2022

(30) Foreign Application Priority Data

Apr. 18, 2019 (GB) ..... 1905499

(51) Int. Cl.
*B65D 71/06* (2006.01)
*B65D 65/22* (2006.01)
(Continued)

(52) U.S. Cl.
CPC ..... *B65D 71/02* (2013.01); *B65D 65/22* (2013.01); *B65D 71/06* (2013.01); *B65D 85/1045* (2013.01); *B65D 2571/00561* (2013.01); *Y10T 428/15* (2015.01)

(58) Field of Classification Search
None
See application file for complete search history.

(56) References Cited

U.S. PATENT DOCUMENTS 3,783,083 A * 1/1974 Jenkins ..... G09F 3/10 206/390
2011/0114518 A1 5/2011 Hein
(Continued)

FOREIGN PATENT DOCUMENTS

EP 3378791 9/2018
GB 2451180 1/2009
(Continued)

OTHER PUBLICATIONS

International Search Report and Written Opinion for PCT/GB2020/050956 date mailed Jun. 9, 2020.
(Continued)

*Primary Examiner* — Alexander S Thomas
(74) *Attorney, Agent, or Firm* — Husch Blackwell

(57) ABSTRACT

An elongate web of wrapping material having a longitudinal axis and a series of lines of weakening spaced from each other in a direction along the axis is disclosed. Each line of weakening is configured to form an extraction opening for the removal of smoking articles from a bundle of smoking articles wrapped in a longitudinal section of the wrapping material cut from the web. A portion of each line of weakening extends in a longitudinal direction, and at least a part of said portion extends at an angle to the longitudinal axis. A method of manufacturing an elongate web of wrapping material is also disclosed.

6 Claims, 8 Drawing Sheets

(51) Int. Cl.
*B65D 71/02* (2006.01)
*B65D 85/10* (2006.01)

(56) References Cited

U.S. PATENT DOCUMENTS

| | | | |
|---|---|---|---|
| 2015/0027916 | A1 | 1/2015 | Buse |
| 2017/0152100 | A1 | 6/2017 | Polloni et al. |

FOREIGN PATENT DOCUMENTS

| | | | | | |
|---|---|---|---|---|---|
| GB | 2503738 | A * | 1/2014 | ..... | B32B 15/08 |
| GB | 2564089 | | 1/2019 | | |
| RU | 2203206 | C2 | 4/2003 | | |
| WO | WO9822367 | | 5/1998 | | |
| WO | WO9928212 | | 6/1999 | | |
| WO | WO2015059655 | | 4/2015 | | |
| WO | WO2016087829 | | 6/2016 | | |
| WO | WO2017060736 | | 4/2017 | | |
| WO | WO2017088973 | | 6/2017 | | |
| WO | WO2018197880 | | 11/2018 | | |

OTHER PUBLICATIONS

"International Preliminary Report on Patentability received for PCT Patent Application No. PCT/GB2020/050956, mailed on Oct. 28, 2021", 9 Pages.
"Office Action received for Russian Patent Application No. 2021133357, mailed on Jun. 23, 2022, 2023", 16 Pages.

* cited by examiner

WRAPPING MATERIAL FOR TOBACCO INDUSTRY PRODUCTS

The present application is a National Phase entry of PCT Application No. PCT/GB2020/050956, filed Apr. 15, 2020 which claims priority from GB Patent Application No. 1905499.8 filed Apr. 18, 2019, each of which is hereby fully incorporated herein by reference.

TECHNICAL FIELD

The present disclosure relates to a web of wrapping material and a method of manufacturing the same.

BACKGROUND

Cigarette packs comprise an outer box made from board which has a base and a hinged lid. A wrapped bundle of cigarettes protrudes from the base so that an upper part is accessible when the lid is rotated back into an open position. The upper part comprises an extraction opening in the wrapping material through which cigarettes can be removed. Some re-sealable bundles comprise a re-stick label for covering the extraction opening and can be repeatedly re-adhered over the extraction opening to provide additional protection for the contents of the bundle.

In packing processes, a web of wrapping material is provided on a reel and drawn into a packing machine. An extraction opening is cut into the wrapping material before a label applicator places a re-stick label over the extraction opening. The web is then cut into individual portions before being wrapped around a bundle of cigarettes.

It is possible to provide a re-sealable bundle in which a re-sealable flap is formed in the wrapping material. This is distinct from re-sealable packs comprising a separate re-stick label to provide the re-sealable function. Re-sealable flaps are formed by providing first and second cuts through respective layers of a laminate wrapping material. The first cut extends through an inner layer of the laminate to define the extraction opening, while the second cut is offset outwardly of the first cut and extends through an outer layer of the laminate to define a cover flap that overlies the extraction opening. The inner and outer layers of the laminate are adhered to each other with at least a re-stick adhesive so that the re-sealable label can be separated and resealed in the region defined between the first and second cuts.

SUMMARY

According to embodiments of the disclosure, there is provided an elongate web of wrapping material having a longitudinal axis and a series of lines of weakening spaced from each other in a direction along the axis, each line of weakening being configured to form an extraction opening for the removal of smoking articles from a bundle of smoking articles wrapped in a longitudinal section of the wrapping material cut from the web, wherein a portion of each line of weakening extends in a longitudinal direction, and at least a part of said portion extends at an angle to the longitudinal axis.

Each line of weakening may be substantially U-shaped to form two ends spaced from each other in a direction that extends transverse to the longitudinal axis.

Each of the series of lines of weakening may comprise two portions that extend in a longitudinal direction with at least a part of each portion extending at an angle to the longitudinal axis.

Said two portions may be connected by an intermediate portion.

The intermediate portion may extend transverse to the longitudinal axis.

The intermediate portion may be joined to each part that extends at an angle to the longitudinal axis by a radius.

Said entire portion of each line of weakening that extends in a longitudinal direction may extend at an angle to the longitudinal axis.

Said portion of each line of weakening that extends in a longitudinal direction may comprise a plurality of discrete sections that extend at an angle to the longitudinal axis.

At least 40% of said portion of each line of weakening that extends in a longitudinal direction may extend at an angle to the longitudinal axis.

Each line of weakening may describe a continuous curve.

The elongate web of wrapping material may be formed from a laminate material.

Each line of weakening of the series may be formed in at least one layer of said laminate material.

Each line of weakening of the series may comprise a first line of weakening formed in one layer of said laminate material, and a second line of weakening formed in another layer of said laminate material.

The first line of weakening may surround the second line of weakening.

A portion of each of the first lines of weakening may extend in a longitudinal direction, and a portion of each of the second lines of weakening may extend in a longitudinal direction, wherein at least a part of said portion of both the first and second lines of weakening extends at an angle to the longitudinal axis.

The elongate web of wrapping material may be wound into a reel for mounting in a machine for wrapping bundles of tobacco industry products in said longitudinal sections cut from said web of wrapping material.

A section of wrapping material may be cut from the elongate web of wrapping material, said section comprising a line of weakening configured to form an extraction opening for the removal of smoking articles from a bundle of smoking articles wrapped in said section, wherein a portion of the line of weakening extends in a longitudinal direction at an angle to the longitudinal axis.

A bundle of tobacco industry products may be wrapped in the section of wrapping material.

A pack of tobacco industry products may be provided, comprising a container and the bundle of tobacco industry products, received in the container.

Also according to embodiments of the disclosure there is provided, a method of manufacturing an elongate web of wrapping material having a longitudinal axis, including forming a series of lines of weakening spaced from each other in a direction along the axis so that each line of weakness will form an extraction opening for the removal of smoking articles from a bundle of smoking articles wrapped in a longitudinal section of the wrapping material cut from the web, the method including cutting at least a portion of each line of weakening that extends in a longitudinal direction at an angle to the longitudinal axis.

The method may comprise winding the elongate web of wrapping material onto a reel after forming a series of lines of weakening in the web.

BRIEF DESCRIPTION OF THE DRAWINGS

Embodiments of the disclosure will now be described, by way of example only, with reference to the accompanying drawings, in which.

DETAILED DESCRIPTION

When wrapping bundles of tobacco industry product, wrapping material is provided to a wrapping facility as an elongate web. The web is cut into individual portions and wrapped about the bundle. Lines of weakening are cut into the wrapping material in the wrapping facility. Each lines of weakening defines an extraction opening in the wrapping material for the removal of tobacco industry products from the wrapped bundle.

Figure 7:
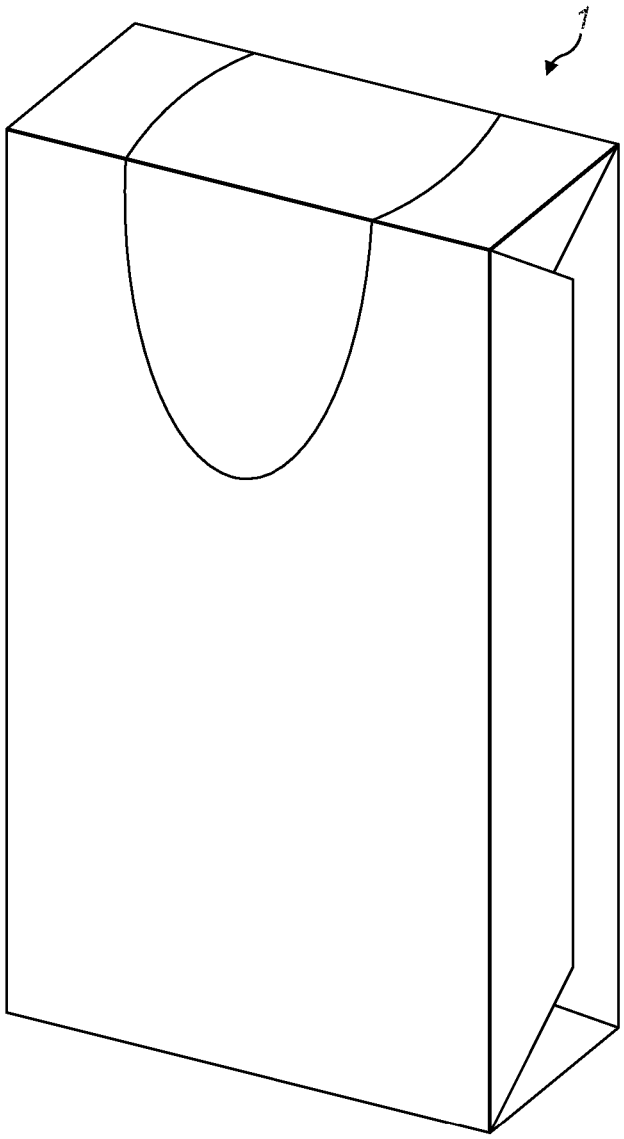
FIG. 7 shows a wrapped bundle.
Figure 10:
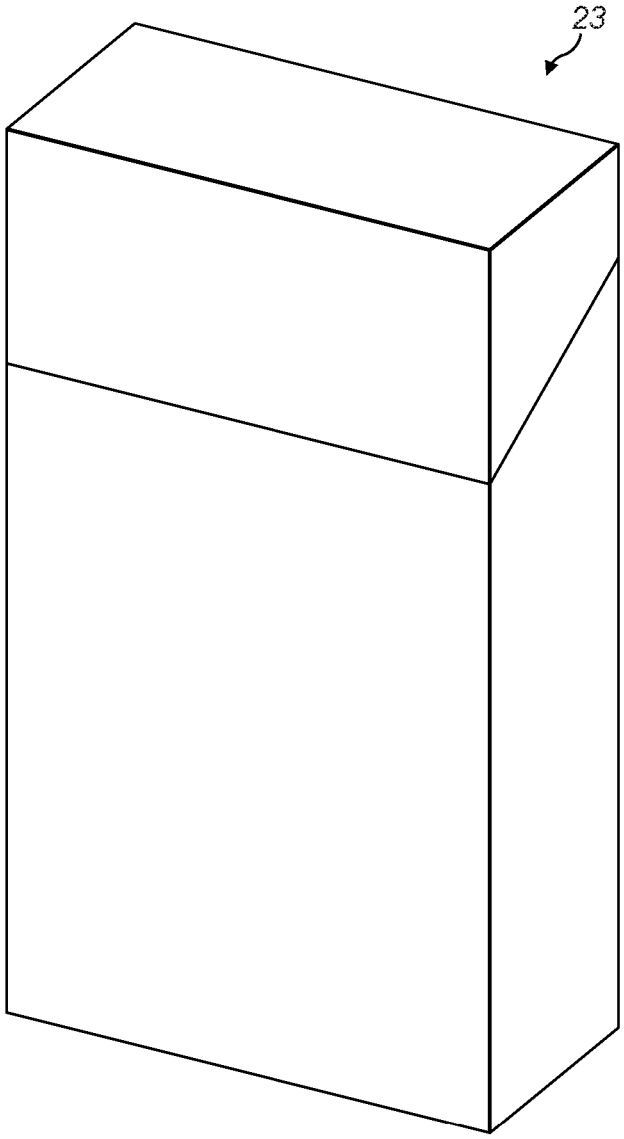
FIG. 10 shows a pack of tobacco industry products.

Re-sealable flaps which are integrally formed in wrapping material can be more complicated to cut. To avoid costly modification of existing wrapping facilities, a separate facility may be provided for cutting re-sealable flaps which are integrally formed in wrapping material. The resulting pre-cut webs of wrapping material are then rolled onto a reel and transported to the wrapping facility, where the web is drawn from the reel and used to wrap a bundle in the normal way. An example wrapped bundle 1 according to an embodiment of the disclosure is shown in FIG. 7. The wrapped bundles 1 are then inserted into an outer pack 23, shown in FIG. 10.

The applicant has observed that cutting lines of weakening into the wrapping material causes an increase in thickness of the material immediately around the lines of weakening. Although the difference in thickness of the wrapping material around the cuts is small and undetectable to the user in normal use of the wrapped bundle, when on a reel, this difference in thickness accumulates if the lines of weakening align with each other across the layers of the reel. The difference in thickness builds up through layers of the reel and creases the web of material; these creases are then visible on bundles wrapped in the wrapping material.

The lines of weakening are typically U shaped and arranged in spaced relation along a longitudinal axis of the web of wrapping material. Each U shaped line of weakening delimits a flap in the wrapping material that can be lifted to provide the extraction opening mentioned above. If any parts of the U shaped lines of weakening are parallel to the longitudinal axis of the web, then said parts will align with each other in different layers of the reel and cause creasing as explained above.

In embodiments of the disclosure, this problem is overcome by cutting into a web 2 of wrapping material 3 lines of weakening 4 in which at least a portion of each line of weakening 4 extending in a longitudinal direction of the web 2 is not parallel to a longitudinal axis of the web A-A.

By longitudinal direction of the web, it is meant a direction which extends along the length of the web. By transverse direction of the web, it is meant a direction perpendicular to the longitudinal axis A-A of the web.

Embodiments of the disclosure provide the technical benefit that creasing of the wrapping material 3 as a result of lines of weakening 4 aligning with each other across the layers of the reel is reduced, if not eliminated completely.

As illustrated in FIGS. 1 to 4, U shaped lines of weakening 4 are provided in spaced relation along the longitudinal axis A-A of the web 2. Each U shaped line of weakening 4 defines a flap in the wrapping material that can be lifted to create an extraction opening when the wrapping material is wrapped about a bundle. Ends 7 of each of the exemplified U shaped lines of weakening 4 are spaced from each other in a direction transverse to the longitudinal axis A-A. Each end is rounded to prevent material enclosed by each U shaped line of weakening 4 from becoming separated from the remainder of the wrapping material 3, 13 when it is lifted during use.

Figure 1:
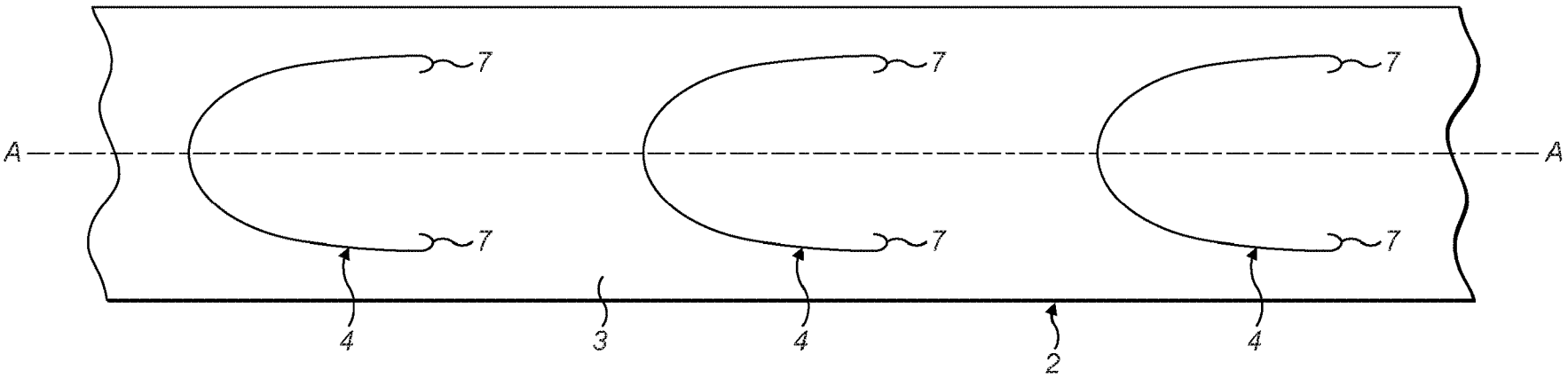
FIG. 1 shows a web of wrapping material according to an embodiment of the disclosure.
Figure 2:
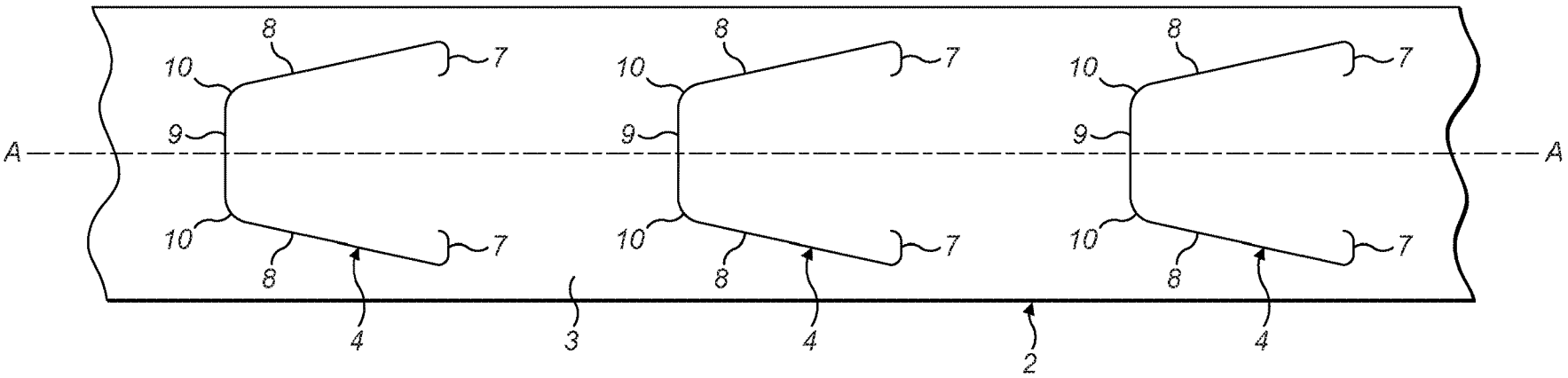
FIG. 2 shows a web of wrapping material according to an embodiment of the disclosure.
Figure 3:
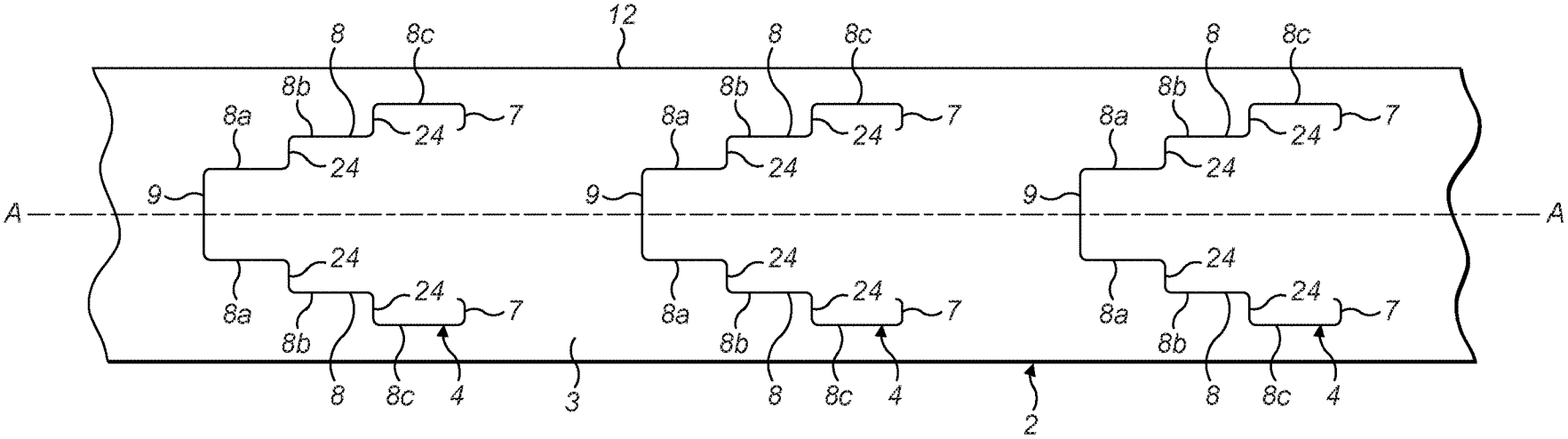
FIG. 3 shows a web of wrapping material according to an embodiment of the disclosure.

In the exemplary embodiments of FIGS. 1 to 3, a re-stick label (not shown) may be applied over the U shaped lines of weakening 4 to allow the bundle to be re-sealed. In such embodiments, the re-stick label is applied to the wrapping material 3 before the wrapping material 3 is wrapped about a bundle.

When a user lifts the re-stick label away from the surface of the wrapped bundle, the flap remains adhered to the re-stick label and separates from the remaining wrapping material 3 to provide the extraction opening. The wrapped bundle can be re-sealed by pressing the re-stick label back down over the extraction opening.

The web 2 of wrapping material 3 of the embodiments described in relation to FIGS. 1 to 3 can comprise any suitable wrapping material known to the person skilled in the art. For example, the wrapping material may comprise an orientated polypropylene or may comprise a metalized paper material.

In the exemplary embodiment of FIG. 1, each U shaped line of weakening 4 describes a continuous curve. As an example, a substantially parabolic curve is illustrated. Each of the lines of weakening 4 extend in a longitudinal direction of the web 2 of material 3. It shall be understood that by 'extends in a longitudinal direction of the web 2 of material 3' it is meant that there is a component of the line of weakening 4 that extends along the length of the web 2, not that it is strictly parallel to the longitudinal axis A-A. On the contrary, as mentioned above, in embodiments of the disclosure at least a portion of each line of weakening 4 extending along the length of the web (i.e. in a longitudinal direction) is not parallel to the longitudinal axis A-A of the web 2.

In another exemplary embodiment, shown in FIG. 2, each U shaped line of weakening 4 comprises two portions 8 that extend in a longitudinal direction of the web 2. The entirety of each portion 8 is arranged at an oblique angle with respect to the longitudinal axis A-A of the web 2. The two portions 8 of each U shaped line of weakening are connected by an intermediate portion 9 that extends transverse to the longitudinal axis A-A of the web 2. A radius 10 chamfers the connection between the intermediate portion and the two portions 8 to strengthen the extraction opening. The two portions 8 diverge as they extend away from the intermediate portion 9.

Because the two portions 8 of the U shaped cut are arranged at an oblique angle with respect to the longitudinal axis, the problem of creasing of the wrapping material on a reel is overcome.

When the webs of wrapping material illustrated in FIGS. 1 and 2 are rolled onto a reel, the problem of creasing of the wrapping material 3 does not arise as the lines of weakening 4 in one layer of the reel do not align with the lines of weakening 4 in an adjacent layer of the reel. This limits the stacking of lines of weakening on top of one another in the reel and prevents the material being creased.

In another exemplary embodiment, shown in FIG. 3, the two portions 8 of each U shaped line of weakening 4 comprise discrete sections 24 that extend at an angle to the longitudinal axis A-A. In this illustrated embodiment, the discrete sections 24 extend transverse to the longitudinal axis. Each of the discrete sections 24 connects parts of the two portions $8_a$, $8_b$, $8_c$ that extend parallel to the longitudinal axis A-A. Therefore, the two portions 8 have a stepped appearance with the parts $8_a$, $8_b$, $8_c$ spaced transverse to the longitudinal axis A-A. As with the embodiment of FIG. 2, each of the two portions is connected by an intermediate portion 9 which extends transverse to the longitudinal axis.

When the web of wrapping material illustrated in FIG. 3 is rolled onto a reel, the problem of creasing of the wrapping material 3 is alleviated. This is because there is less overlap between lines of weakening 4 in adjacent layers of the reel. The applicant has noticed that the lines of weakening only overlap where they are each parallel to the longitudinal axis and equally spaced in a transverse direction from an edge 12 of the web 2. Therefore, by spacing the parts $8_a$, $8_b$, $8_c$ in a direction transverse to the longitudinal axis A-A, the amount of overlap between of lines of weakening 4 across the layers of the reel is reduced. Only parts equally spaced from an edge 12 of the web 2 may overlap. This limits the cumulative length of lines of weakening 4 that stack up on top of one another in the reel and reduces creasing in the material.

In exemplary embodiments, the U shaped lines of weakening of FIGS. 1 to 3 comprise any of: a perforated line in the wrapping material 3, a score line in the wrapping material 3 or a complete cut through the material 3. Therefore the line of weakening 4 allows the flap to be separated from the remaining portion of the wrapping material 3 to provide an extraction opening in the way described above.

The U shaped lines of weakening 4 of embodiments described herein may be formed in any manner apparent to the skilled person. For example, the lines of weakening 4 may be formed in a kiss cutting operation in which the web 2 of material 3 is repeatedly stamped by kiss cutter as it is conveyed through a cutting station. Alternatively, the lines of weakening 4 may be cut by a laser. The laser may be configured to translate over the surface of the web 2 as it is conveyed through the cutting station.

Figure 4:
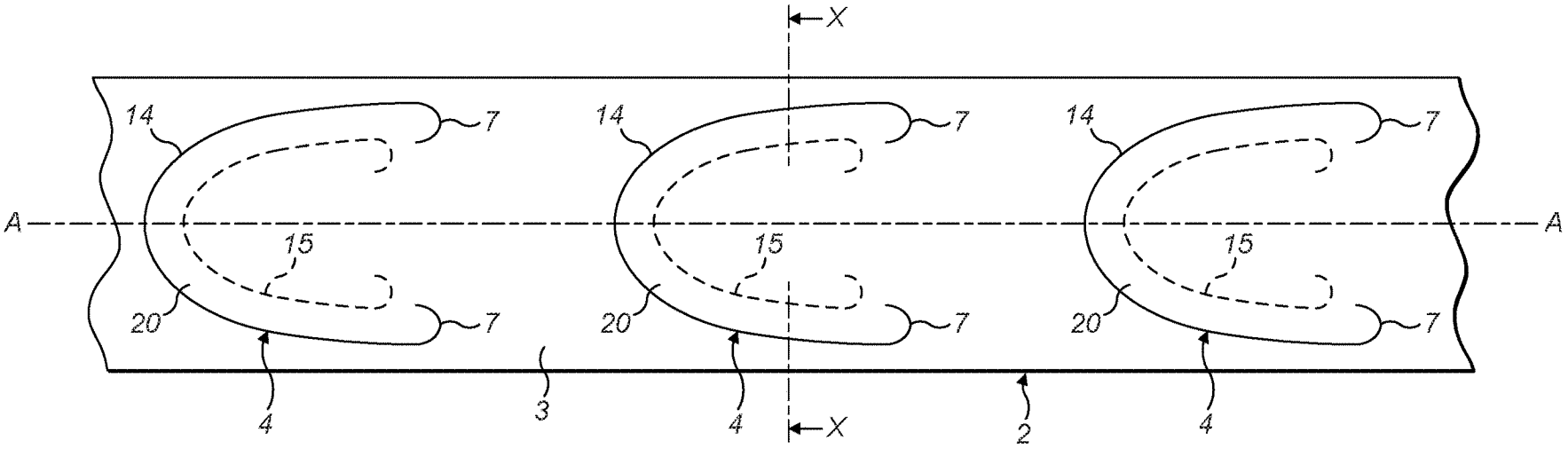
FIG. 4 shows a web of wrapping material according to an embodiment of the disclosure.

FIG. 4 shows a web 2 of wrapping material 13 according to another embodiment in which the wrapping material 13 comprises a laminate material. First and second U shaped cuts 14, 15 are provided in spaced relation along a longitudinal axis A-A of the web 2. The first and second cuts 14, 15 define a re-sealable cover flap 16 and a flap 17 for forming an extraction opening, respectively, that is integral with the laminate material 13 as explained below. Forming the flap 17 and the cover flap 16 from cuts 14, 15 made in a laminate material 13 obviates the need to provide a separate re-stick label to cover the opening.

Figure 5:
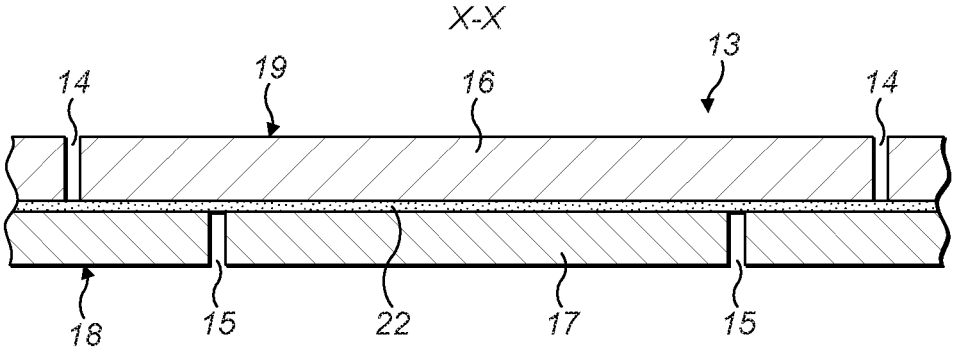
FIG. 5 shows a section of the web of FIG. 4.

The laminate material 13 comprises an inner and outer layer 18, 19, shown in FIG. 5. When the wrapping material 13 is wrapped about a bundle of cigarettes to form a wrapped bundle, the outer layer 19 is disposed on the outside of the wrapped bundle facing away from the cigarettes and the inner layer 18 is on the inside of the wrapped bundle, facing toward the cigarettes The first cut 14 is provided in the outer layer 19 and the second cut 15 is provided in the inner layer 18. The first cut 14 extends through or substantially through the outer layer 19 of the laminate material 13. The first cut 14 does not extend into the inner layer 18 of the laminate material 13. The second cut 15 extends through or substantially through the inner layer 18 of the laminate material 13. The second cut 15 does not extend into the outer layer 19 of the laminate material 13.

The second cut 15 delimits the flap 17 in the inner layer 18 of the laminate material 13. The first cut 14 delimits the cover flap 16 in the outer layer 19 of the laminate material 13. The second cut 15 is offset and spaced from the first cut 14, such that the second cut 15 is disposed entirely within a boundary defined by the first cut 14. A peripheral region 20 is defined in the space between the first and second cuts 14, 15.

Figure 6:
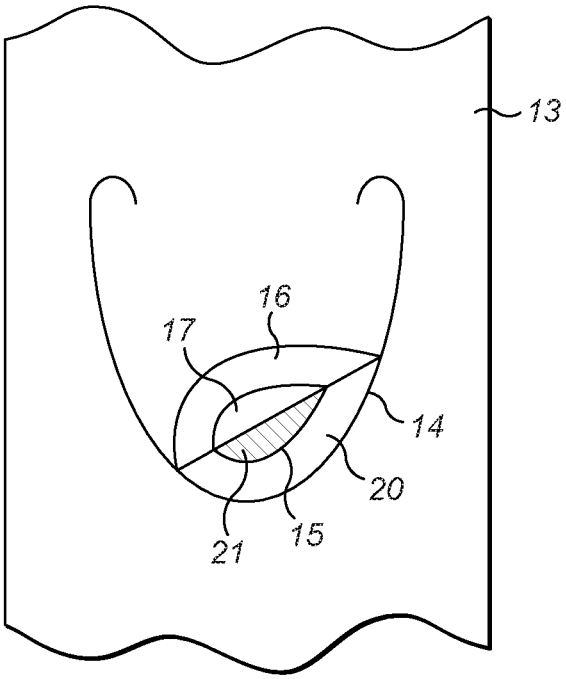
FIG. 6 shows a portion of a wrapped bundle formed from the web of FIG. 4.

FIG. 6 shows the laminate wrapping material 13 of a wrapped bundle in a region encompassing first and second cuts 14, 15. As shown, the cover flap 16 and flap 17 of the laminate 13 separate from the remainder of the laminate material 13 along the first and second cut lines 14, 15. In this way, the cover flap 16 and flap 17 of the laminate material 13 are lifted away from the remainder of the laminate material 13 to form an extraction opening 21 for the removal of cigarettes.

As shown in FIG. 5, pressure sensitive adhesive 22 extends between the inner and outer layers 18, 19 of the laminate 13 to attach them to each other. Lifting the cover flap 16 causes delamination of the inner and outer layers 18, 19 in the peripheral region 20 between the first and second cuts 14, 15, while the flap 17 remains attached to the cover flap 16 due to the pressure sensitive adhesive 22. Therefore the boundary of the extraction opening 21 is defined by the second cut 15. When the cover flap 16 is repositioned over the peripheral region 20, the inner and outer layers 18, 19 will re-stick due to the pressure sensitive adhesive 22, allowing the wrapped bundle to be re-sealed. The bundle can be opened and re-sealed as many times as the pressure sensitive adhesive 22 will endure.

The inner and outer layers 18, 19 may be made from any material known in the art. For example, the inner and outer layers 18, 19 may be made from oriented polypropylene. In embodiments additional layers may be added, for example an intermediate layer (not shown) of aluminum foil. In such embodiments the first cut 14 may extend through the intermediate and outer layers, so that the intermediate layer forms part of the cover flap 16. Alternatively, the first cut 14 may extend only through the outer layer 19, while the second cut 15 extends through both the inner and intermediate layers, so that the intermediate layer forms part of the flap 17.

Each of the first and second cuts 14, 15 of the illustrated embodiments describe a continuous curve. However, it shall be appreciated that the first and second cuts 14, 15 may describe any shape that delivers the required technical effect of alleviating creasing in the wrapping material 13. In exemplary embodiments, either of the first cut and second cut 14, 15 may be a shape described with reference to the U shaped lines of weakening 4 of FIGS. 1 to 3. The only limitation on the shape of the first and second cuts 14, 15 is that the second cut 15 must lie within the boundary defined by the first cut 14 to provide the functionality described above.

In an exemplary embodiment, the first and second cuts 14, 15 are formed in the web 2 of laminate material 13 using a laser. The power of the laser is set to cut only the layers of the laminate required of the first and second cuts 14, 15. Following formation of the first and second cuts 14, 15 the web of material 13 is rolled onto a reel and transported to a wrapping station as described above.

Figure 8:
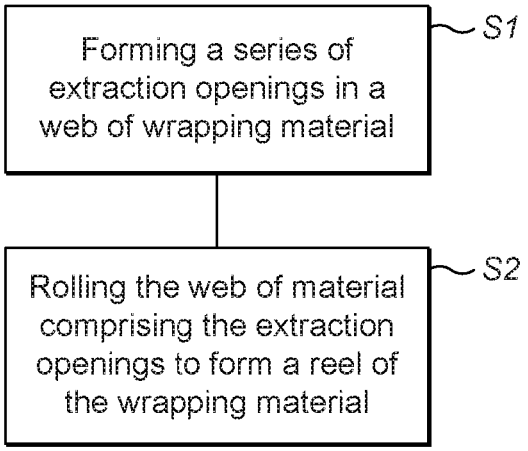
FIG. 8 shows schematically a method for forming a reel of wrapping material.
Figure 9:
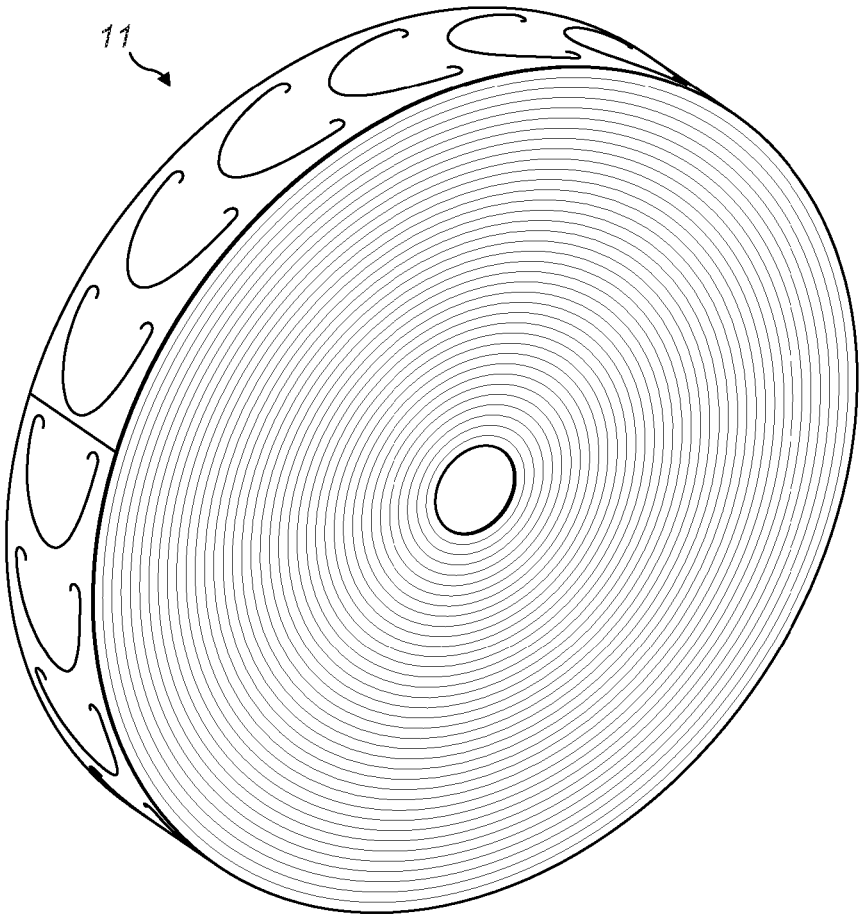
FIG. 9 shows a reel of wrapping material.

A web of wrapping material 3, 13 may be prepared according to any of the embodiments described herein by, in a first step S1, forming a series of extraction openings into the web of wrapping material and, in a second step S2, rolling the web of material comprising the extraction openings to form a reel 11 of the wrapping material 3, 13. These steps are shown schematically in FIG. 8. A reel of wrapping material according to embodiments of the disclosure is shown in FIG. 9.

The reel 11 may then be transported to a wrapping facility for wrapping bundles of tobacco industry products in the normal way. For example, the wrapping material may be fed into a wrapping station where it is cut into individual portions and wrapped about a bundle to form a wrapped bundle, substantially akin to the bundle 1 shown in FIG. 7.

A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, hybrid devices comprising a combination of aerosol generating materials or their consumables, lozenges and gum. This list is not intended to be exclusive, but merely illustrates a range of products which are made and sold in the tobacco industry.

In order to address various issues and advance the art, the entirety of this disclosure shows by way of illustration various embodiments in which the claimed invention(s) may be practiced and provide for superior methods of preparing wrapping material for tobacco industry products, as well as superior reels of wrapping material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An elongate web of wrapping material having a longitudinal axis and a series of U-shaped lines of weakening spaced from each other in a direction along the axis, each line of weakening being configured to form an extraction opening for the removal of smoking articles from a bundle of smoking articles wrapped in a longitudinal section of the wrapping material cut from the web, wherein each line of weakening comprises rounded ends spaced from each other in a direction transverse to the longitudinal axis, a portion of each line of weakening extending in a longitudinal direction, wherein each line of weakening is a continuous curve extending between said rounded ends, wherein no part of said continuous curve extending between said rounded ends is parallel to the longitudinal axis.

2. An elongate web of wrapping material according to claim 1, formed from a laminate material.

3. An elongate web of wrapping material according to claim 2, wherein each line of weakening of the series is formed in at least one layer of said laminate material.

4. An elongate web of wrapping material according to claim 3, wherein each line of weakening of the series comprises a first line of weakening formed in one layer of said laminate material, and a second line of weakening formed in another layer of said laminate material.

5. An elongate web of wrapping material according to claim 4, wherein the first line of weakening surrounds the second line of weakening.

6. An elongate web of wrapping material according to claim 1, wound into a reel for mounting in a machine for wrapping bundles of tobacco industry products in said longitudinal sections cut from said web of wrapping material.

* * * * *